United States Patent [19]

Kimberlin

[11] Patent Number: 4,466,777

[45] Date of Patent: Aug. 21, 1984

[54] PUMP CONTROL CIRCUIT

[75] Inventor: Denver K. Kimberlin, Pauls Valley, Okla.

[73] Assignee: Engineering Enterprises, Inc., Oklahoma City, Okla.

[21] Appl. No.: 389,594

[22] Filed: Jun. 18, 1982

[51] Int. Cl.³ ..... F04B 49/00

[52] U.S. Cl. ..... 417/12; 417/36; 417/44; 417/63

[58] Field of Search ..... 417/12, 44, 45, 36–40, 417/63; 166/53; 137/392

[56] References Cited

U.S. PATENT DOCUMENTS

| | | | |
|---|---|---|---|
| 4,112,291 | 9/1978 | Fukuyama et al. | 377/17 |
| 4,171,932 | 10/1979 | Miller | 417/36 |
| 4,265,262 | 5/1981 | Hotine | 417/36 X |

OTHER PUBLICATIONS

IBM Technical Disclosure Bulletin, "Direct Digital-to-Analog Values Storage", J. W. Beck, vol. 9, No. 4, Sep. 1966.

Schematic Diagram.

*Primary Examiner*—Edward K. Look

*Attorney, Agent, or Firm*—Laney, Dougherty, Hessin & Beavers

[57] ABSTRACT

A circuit for controlling a pump for pumping a column of gasoline floating on a column of water. A first probe is positioned at the level of the pump intake and a second probe is positioned beneath the first probe. A float switch is positioned adjacent the pump intake for providing a signal when the pump is immersed in liquid. The float switch and the probes are operatively connected to an AND gate circuit which generates a preselected signal when both probes are immersed in a non-conducting liquid. A time delay is operatively connected to the AND gate and begins a timing period responsive to the preselected signal. At the end of the timing period, the time delay provides a signal which energizes the pump. A latch circuit maintains the pump in an energized condition until both probes are again immersed in water.

5 Claims, 3 Drawing Figures

PUMP CONTROL CIRCUIT

BACKGROUND AND SUMMARY OF THE INVENTION

The instant invention pertains to a control circuit for a pump, and more particularly to such a circuit which controls a pump of the type for pumping hydrocarbons which are floating on water.

One use for such pumps is for recovering spilled hydrocarbon products in and around facilities where such products are handled. For example, in a refinery, hydrocarbon products may spill onto the ground and seep downwardly until the water table is encountered. Over a period of years, thousands of gallons of hydrocarbons may float on the surface of the water table in and around the refinery.

In the past, wells have been drilled in order to recover such floating hydrocarbons. When such a well is dug, a first pump is lowered to the bottom of the well to pump water from the bore. As water is pumped from the bore, water surrounding the bore begins flowing toward the bore. The surface of the water table assumes an inverted cone shape centered about the bore. The hydrocarbons floating on the water table thus begin flowing on the surface of the inverted cone toward the well bore. Thus, the bore includes a lower column of water having an upper column of hydrocarbons floating on the water.

In order to recover the floating hydrocarbons in the bore, a second pump is lowered on a cable to the surface of the hydrocarbon/water interface. The pump includes a pump intake, a first electrical probe located at the pump intake, and a second electrical probe located about four inches beneath the pump intake. A common elongate probe is mounted against both the first and second probes. Adjacent the pump intake, a float is provided which switches a switch when the intake is immersed in liquid.

A power source is provided for energizing the pump and a control circuit is provided for selectively applying the power source to the pump. The prior art control circuit is formed substantially from transistors and diodes and receives inputs from the probes and from the float switch. The circuit applies voltage to the common probe and detects presence or absence of such voltage on each of the first and second probes. Presence of the common voltage on either of the probes indicates that the probes are immersed in water, such conducting the voltage to the probe. The absence of the voltage indicates that the probes are immersed in either the hydrocarbon, which has a very high resistance, or in air (also having a high resistance). Detection of the condition of the float switch indicates whether or not the pump is in liquid or in air. Thus, if the float switch indicates the pump is in liquid and the common voltage is not present at one of the probes, that probe is immersed in the hydrocarbon.

The prior art control circuit functions in one of two modes. In the first mode, the pump is lowered until the intake is just above the water/hydrocarbon interface. As the hydrocarbons flow into the bore, the weight of the hydrocarbons forces the interface downwardly until the lower probe is immersed in the hydrocarbon. At this point, the control circuit applies power to the pump, and a latch circuit latches the pump in an on condition until the pump pumps sufficient hydrocarbons so that both probes are again immersed in water. The circuit removes power from the pump until both probes are again received within the hydrocarbon.

In its second mode, when the high probe is in hydrocarbon, a time delay begins a timing period. At the end of the timing period, the pump is energized and the hydrocarbon is pumped until the high probe is again immersed in the hydrocarbon. This cycle is thereafter repeated.

This past control circuit is deficient in several respects. The circuit is formed from discrete components and is difficult to service and less reliable than integrated circuitry. Further, a problem is created in the old circuit due to the variation from well to well of the time in which a given amount of hydrocarbon flows into the bore. For example, when operating in the first mode in a fast well, the pump may be turning on and off very frequently.

In the second mode, a certain amount of trial and error setting of the time delay is necessary to prevent rapid on-and-off switching of the pump and to insure the pumps will be energized a sufficient amount of time.

It is a general object of the present invention to provide a pump control circuit for the above-described pump which overcomes the disadvantages of past circuits.

It is a more specific object of the invention to provide such a circuit which, although including a variable time delay, has only one mode of operation.

It is another specific object of the instant invention to provide such a circuit in substantially all integrated circuit form.

In the instant invention, the first and second probes as well as the float switch on the pump are operatively connected to an AND gate circuit. The AND gate circuit is operatively connected to a time delay which in turn is connected to a pump energization circuit. The AND gate circuit generates a signal which starts the time delay when both probes are immersed in a nonconducting liquid. After the timed period, the time delay provides a signal to the pump energization circuit which starts the pump. A latching circuit operatively connected to the probes, the float switch, and to the pump energization circuit maintains the pump in an energized condition until both probes are again immersed in a conducting liquid.

These and other objects and advantages attained by the instant invention will become more apparent as the following detailed description is read in view of the accompanying drawings.

DETAILED DESCRIPTION OF THE INVENTION

Figure 1:
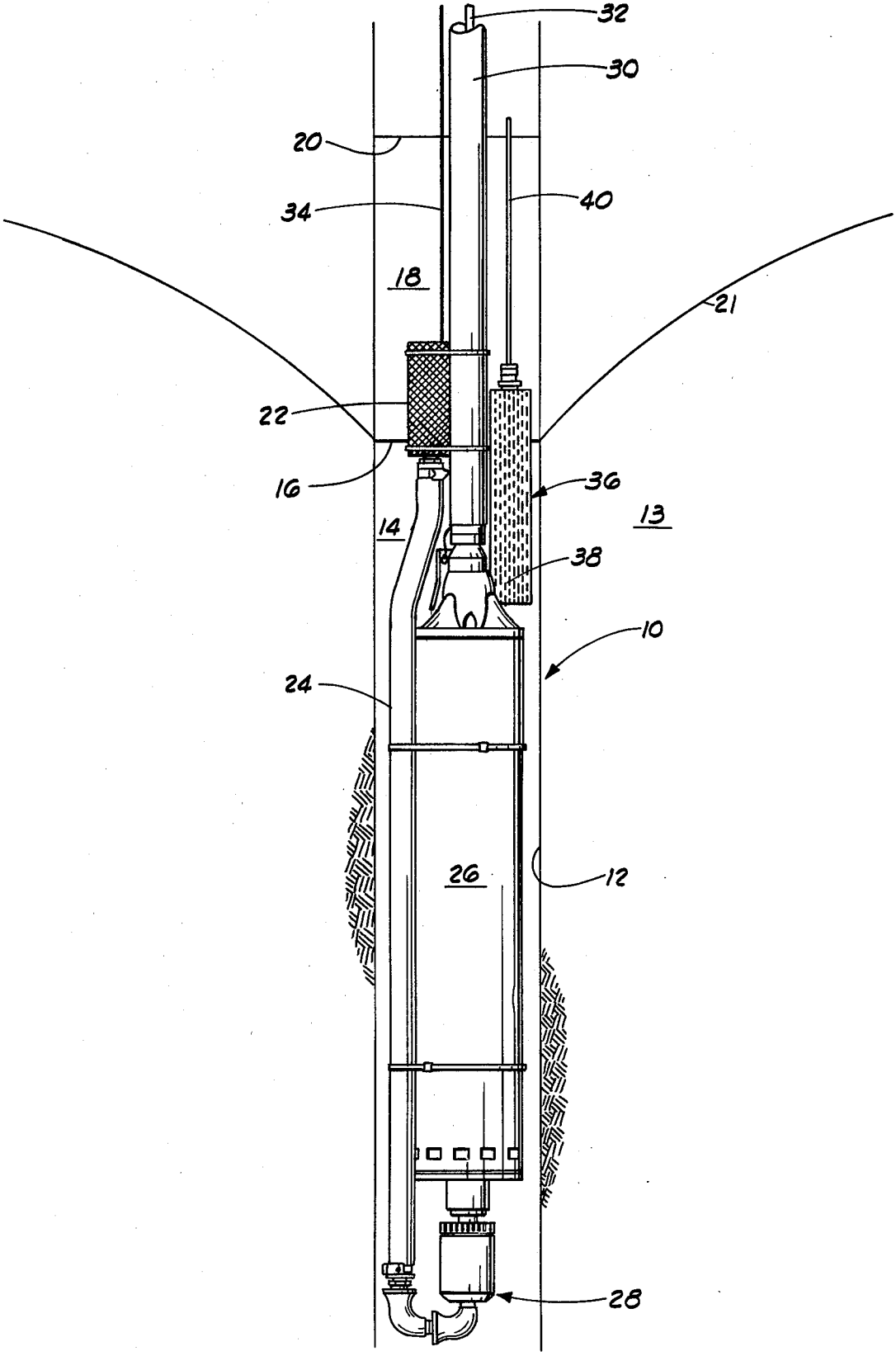
FIG. 1 is a front elevation view of the pump including the probe assembly, suspended in a well bore.

Turning now to FIG. 1, indicated generally at 10 is a pump assembly. The assembly is lowered into a well bore 12 drilled in a formation 13. The lower end of the well bore is filled with a column of water 14. A column of hydrocarbons or gasoline 18 having a top surface 20 and a bottom surface or interface 16 is floating on water column 14. There is no liquid in well bore 12 above surface 20.

Although not visible in FIG. 1, a water pump is positioned at the bottom of well bore 12 for pumping water up the bore via a hose (not shown) to the surface. Such pumping of the water from the bore causes an inverse coning of the water table surrounding bore 12 as the water in formation 13 flows toward the well bore. The inverse water cone includes a top surface 21 formed about the circumference of the well. Any gasoline floating on surface 21 flows along the surface of the cone into bore 12 to become a part of gasoline column 18.

Pump assembly 10 includes an intake strainer 22, a gasoline intake hose 24 and a pump 26. Hose 24 is connected to pump 26 via couplings indicated generally at 28. A gasoline output hose 30 is connected to pump 26 and extends upwardly to the surface. A pump motor power cable 32 is received within hose 30. Intake strainer 22 is fixedly attached to hose 30. Pump 26 is connected to a steel cable 34 which extends upwardly to the surface. The weight of pump assembly 10 is supported by cable 34.

A probe assembly 36 is fixedly mounted on cable 30 and on pump 26 in the position shown. The probe assembly includes a housing 38, such having a plurality of holes which permit fluid communication between the exterior and the interior of the probe assembly. A six-conductor electrical cable 40 is attached to components within probe assembly 36 and extends upwardly to the surface. A plug 41 is provided for connecting cable 40 to a circuit, shown in FIG. 3, as will be later described.

Figure 2:
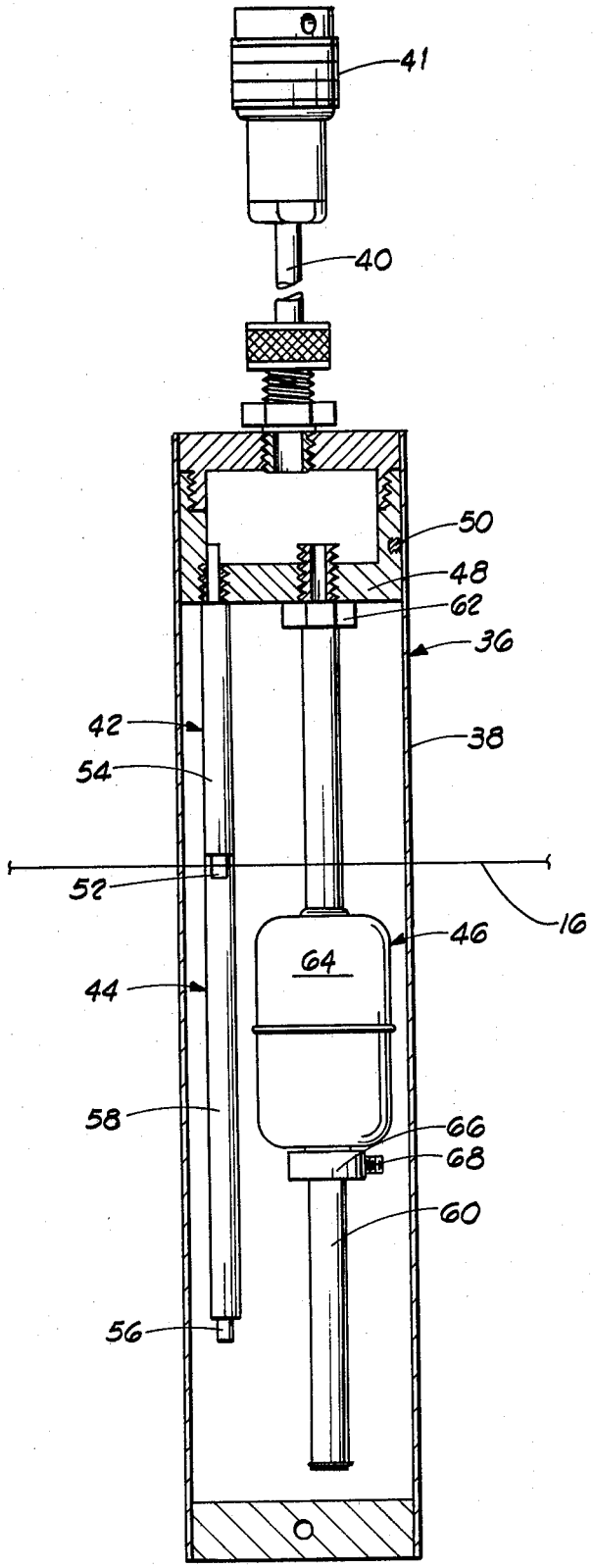
FIG. 2 is an enlarged view, shown partly in cross section, of the probe assembly of the pump of FIG. 1.

For a view of the components within assembly 36, attention is directed to FIG. 2. The probe assembly includes a high probe 42, a low probe 44 and a float assembly 46, each of which are threadably engaged with bores in a generally cylindrically shaped top portion 48. Top portion 48 is fixed in location by means of a set screw 50 received within bores in both housing 38 and in top portion 48. The top portion is formed from electrically nonconducting polyvinyl chloride.

High probe 42 includes a stainless steel rod 52 which extends from the bottom of the probe upwardly into top portion 48. Except for the lowermost portion of high probe 42, rod 52 is sheathed by electrically nonconducting Teflon tubing 54 which extends upwardly to the lower surface of top portion 48.

Low probe 44 is similarly constructed and includes a similar stainless steel rod 56 which extends into top portion 48 as well as an electrically nonconducting Teflon tubing 58 over rod 56 which extends upwardly to the lower surface of top portion 48. Low probe 44 in theinstant embodiment of the invention, is four inches longer than high probe 42 which leaves the exposed lower portions of each of stainless steel rods 52, 56 separated by a vertical distance of four inches. With respect to the longitudinal axis of housing 38, high probe 42 and lower probe 44 are radially separated by an arc of approximately 30°.

Float assembly 46 includes a stainless steel rod 60 which is fixedly attached to top portion 48 via a nut 62. A float 64 is slidable along the length of the rod. The lower travel of float 64 is limited by a float position clamp ring 66. Clamp ring 66 is positionable at selected vertical intervals along rod 60 with a set screw 68.

Although not visible in FIG. 2, rod 60 includes a pair of normally open magnetic reed switches contained within the rod. Each of the reed switches are of the single-pole, single-throw type and have one side of each connected in common. The lower of the two reed switches has its contacts positioned within the rod at the same level as the exposed lower portion of rod 52 in high probe 42. With the pump assembly as positioned as shown in FIGS. 1 and 2, the contacts of the lower switch are at the level of water/gasoline interface 16. The second of the two reed switches has its contacts positioned approximately midway between the contacts of the lower reed switch and the lower surface of top portion 48. Float 64 includes an internal magnet (not visible) disposed about the radially inner circumference of the float adjacent rod 60. When the float moves upwardly, the magnet passes over the magnetic switch contacts causing it to close. Thus, when float 64 moves to its uppermost position on rod 60, both of the reed switches are switched to their closed condition. It can be seen that as probe assembly 36 is lowered into liquid, float 64 floats in the liquid and begins moving upwardly with respect to rod 60. When the lower of the two reed switches close, the lower exposed portion of rod 52 has just become immersed in the liquid.

The six conductors in cable 40 are connected in probe assembly 36 as follows: one of the conductors is electrically connected to rod 52; one is connected to rod 56; one is connected to rod 60; one is connected to the common side of the reed magnetic switches; one is connected to the other side of the lower reed magnetic switch; and one is connected to the other side of the upper reed magnetic switch.

Figure 3:
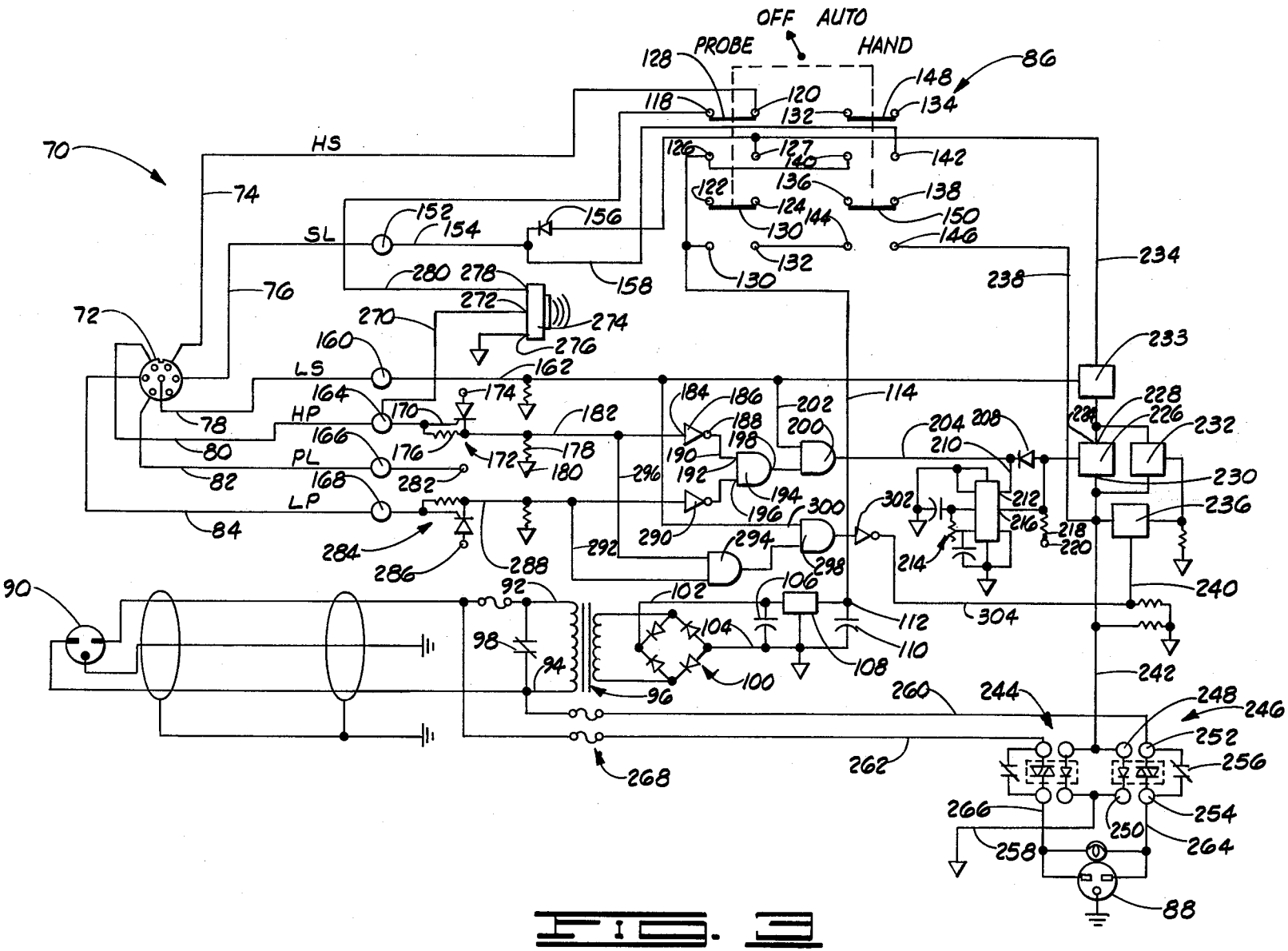
FIG. 3 is a schematic diagram of a circuit for controlling the pump of FIG. 1.

Turning to FIG. 3, indicated generally therein at 70 is a pump control circuit constructed in accordance with the present invention. The circuit includes a cable receptacle 72, such being constructed to receive cable plug 41 attached to the end of electrical cable 40. Six conductors 74, 76, 78, 80, 82, 84 are electrically connected to sockets in receptacle 72 on one end of each conductor. The other end of each conductor is connected in circuit 70 as will later be more fully described.

For convenience, each of the six conductors is marked with a pair of capital letters to designate the component in probe assembly 36 to which the conductor is attached via cable 40. Conductor 76 (designated SL) is connected to the common side of the reed magnetic switches contained within rod 60. Conductor 74 (designated HS) is connected to the other side of the high switch. Conductor 78 (designated LS) is connected to the other side of the low switch. Conductor 80 (designated HP) is connected to rod 52 in high probe 42. Conductor 82 (designated PL) is connected to rod 60 in float assembly 46. Conductor 84 (designated LP) is connected to rod 56 in low probe 44.

Indicated generally at 86 is a function switch which, as will later be more fully described, serves to form different circuit configurations dependent upon the desired pump function.

A power plug receptacle 88 is provided for receiving a plug (not shown) on the upper end of power cable 32. When voltage is applied to the cable, the pump is energized and pumping. Circuit 70 controls the energization of the pump dependent upon the signals received at receptacle 72 and upon the position of switch 86.

A conventional 220-volt plug 90 is provided for supplying power to control circuit 70 as well as for providing power to the pump via receptacle 88 under control of circuit 70. When plug 90 is plugged into a conventional 220-volt, alternating current source, the voltage is applied across conductors 92, 94 and thus across the primary of a conventional transformer 96. A conventional varistor 98 provides protection against high-voltage spikes. When the normal 220-volt alternating current voltage is applied across the varistor, the resistance of varistor 98 is very high. In the presence of abnormally high voltages, the resistance of varistor 98 drops substantially thus shorting the high-voltage and preventing damage to circuit 70. The output of transformer 96 is applied across a diode bridge 100 which provides a rectified DC voltage across conductors 102, 104.

Conductors 102, 104 are applied across a capacitor 106, a conventional positive voltage regulator 108, and a second capacitor 110. Both of the capacitors and regulator 108 function to provide a positive direct current voltage on a terminal 112. The voltage appearing on terminal 112 is approximately 6-volts direct current and is referred to herein as the power supply voltage. A conductor 114 electrically interconnects terminal 112 and portions of switch 86.

Switch 86 includes left upper terminals 118, 120, 122, 124 and left lower terminals 126, 127, 130, 132. Left arms 128, 130 are made from electrically conductive material and, in the position shown in FIG. 3, provide electrical connection between terminals 118, 120 and between terminals 122, 124. Arms 128, 130 are linked for parallel movement with a mechanical linkage (not shown) so that when arm 128 is switched downwardly to place terminals 126, 127 in electrical contact, arm 130 likewise moves downwardly placing terminals 130, 132 in electrical contact.

Switch 86 further includes right upper terminals 132, 134, 136, 138 and right lower terminals 140, 142, 144, 146. Arms 148, 150 are likewise mechanically linked and can be placed in either of two positions, one of which is as shown. The second position for arms 148, 150 is in a lower position in which arm 148 spans terminals 140, 142 and places them in electrical contact while arm 150 does the same for terminals 144, 146.

When switch 86 is in the OFF position, the arms are in the position shown. When the switch is placed in the PROBE position, arms 148, 150 are moved to their low position while arms 128, 130 remain in their high position. In the AUTO position, arms 128, 130 are low while arms 148, 150 remain high. In the HAND position, all of the arms are in their lowermost positions.

Consideration will now be given to the connections made by conductors 74–84 within circuit 70. Conductor 74 (which as will be recalled, is electrically connected to the noncommon side of the higher of the two magnetic reed switches contained within rod 60 in probe assembly 36) is connected to terminal 120 in switch 86. Conductor 76 is connected to a terminal 152 which is in turn connected to a conductor 154. Conductor 154 is connected to the cathode side of a conventional diode 156. The anode side of the diode is connected to terminal 127 in switch 86. The diode functions in a conventional manner, i.e., when the voltage on the anode side of the diode is greater than the voltage on the cathode side, current may flow through the diode. When the voltage on the cathode side is greater than the anode voltage, no current flows. Conductor 154 is connected via conductor 158 to terminal 142 in switch 86.

Conductor 78 is connected via terminal 160 to a conductor 162. Conductors 80, 82, 84 are connected to terminals 164, 166, 168, respectively. Terminal 164 is electrically connected to a gate lead 170 of a conventional silicone-controlled rectifier or SCR indicated generally at 172. SCR 172 includes an anode which is electrically connected to a terminal 174. Although the connection is not shown in the schematic, terminal 174 is electrically connected via a conductor (not shown) to terminal 112. Thus, the power supply voltage appears on terminal 174. A resistor 176, in the instant circuit having a resistance of 1,000-ohms, is connected between gate 170 and the anode of SCR 172. A second resistor 178, in the instant circuit having a resistance of 500,000-ohms, is connected between the cathode of SCR 172 and a ground terminal 180. Ground terminal 180 is shown in the schematic in the conventional manner, i.e., a triangular configuration. Other ground terminals are shown in the schematic which may not be identified as such; however, all of the terminals having the configuration of terminal 180 in the schematic are electrically grounded.

SCR 172 functions in a manner common to all SCR's. When the voltage on the anode of the SCR is greater than that appearing at the cathode and when a voltage appears on gate 170 which is greater than the voltage at the cathode, current may flow between terminals 174, 180. In the instant configuration, SCR 172 has the positive power supply voltage applied on its anode. Accordingly, whenever a positive voltage appears on gate 170, the SCR conducts and the voltage at terminal 174 is applied between resistor 178 and ground.

The cathode of SCR 172 is electrically connected via a conductor 182 to an input terminal 184 of an inverter 186. Inverter 186 is a conventional integrated-circuit inverter for inverting digital voltages. The digital voltages which are used in the instant circuit are binary voltages, i.e., voltages having only two levels—a low level and a high level. In the instant circuit, the low level is about zero volts while the high level is about 6-volts. When a low level is applied to input terminal 184 of inverter 186, a high level appears on an output terminal 188. Conversely, when a high level is applied to input terminal 184, a low level appears on the output terminal.

A conductor 190 connects output terminal 188 to an input terminal 192 of an AND gate 194. AND gate 194 includes a second input terminal 196 and an output terminal 198. AND gate 194 is a conventional integrated-circuit AND gate which, like convertor 186, operates on binary voltages. When a high voltage appears both on input terminals 192, 196, a high voltage appears on output terminal 198. When any other combination of voltages appears on input terminals 192, 196, e.g., a high voltage on 192 and a low voltage on terminal 196, a low voltage level appears on output terminal 198. AND gate 194 is referred to herein as first AND means or gate.

Output terminal 198 is applied via a conductor as shown to one of the input terminals of an AND gate 200. AND gate 200 is referred to herein as float AND means or a third AND gate and includes the same terminal arrangement and functions in the same manner as AND gate 194. The other input terminal of AND gate 200 is connected via a conductor 202 to conductor 162. The output terminal of AND gate 200 is connected to a conductor 204. Conductor 204 is connected both to the cathode of a diode 208 and to a conductor 210 which in turn is connected to an input terminal 212 of a conventional integrated-circuit time delay or timer, indicated generally at 214. Timer 214 includes an output terminal 216, such being applied to a conductor as shown for placing output terminal 216 in electrical contact with one side of a two megohm resistor 218. The other side of resistor 218 is applied to a terminal 220 which is connected via a conductor (not shown) to terminal 112 for placing the power supply voltage on terminal 120. Output terminal 216 is also connected via conductors to the anode of diode 208. Diode 208 is of substantially identical structure as previously-described diode 156 and functions in the same manner. Timer 214 includes conventional biasing capacitors and resistors (not identified by numerals) which are connected to other timer terminals (also not identified) in a conventional manner in order to effect desired timer function.

When input terminal 212 of timer 214 goes to a high voltage level, a preselected time is timed by the timer. At the end of the preselected time, output terminal 216 goes to a high level (assuming a high level is still maintained on terminal 212). Output terminal 216 can only be high if input terminal 212 is at a high voltage level.

The anode of diode 208 is connected via conductor as shown with a control terminal 224 of a bilateral switch 226. Switch 226 includes two switch terminals 228, 230. Switch 226 is controlled by a binary signal applied to control terminal 224. When a low voltage level appears at gate 224, terminals 228, 230 are in electrical isolation from each other and no current may flow between the terminals. When control terminal 224 is placed at a high voltage level, terminals 228, 230 are placed in electrical contact with each other and current may flow between the terminals. Thus, the switch may be considered in its "closed" condition. A second bilateral switch 232 having opposing switch terminals and a control terminal, which function in the same manner as the terminals on switch 226, has its switch terminals placed in parallel (via conductors as shown) with switch terminals 228, 230 of switch 226. A third bilateral switch 233 likewise includes opposing switch terminals and a control terminal, the control terminal being electrically connected to conductor 162. One of the switch terminals is electrically connected via a conductor as shown with terminal 228 on switch 226. The other switch terminal is electrically connected to a conductor 234 having its other end electrically connected to terminal 127 in switch 86. A fourth bilateral switch 236 includes the same structure and functions in the same manner as the other bilateral switches. One of the switch terminals of switch 236 is placed in electrical contact with the control terminal of switch 232 via conductors as shown. The other switch terminal is electrically connected to a conductor 238 and the control terminal is electrically connected to a conductor 240. Switch 226 is referred to herein as switch means or pump energizing means while switches 232, 236 are referred to herein as a latch or latching means.

Switch 226 has its switch terminal 230 electrically connected to a conductor 242 which in turn is connected to conductor 238 and to a pair of solid state relays indicated generally at 244, 246. Relay 246 includes a pair of control terminals 248, 250 and a pair of gate terminals 252, 254. Relay 246 is of conventional structure and functions in a conventional manner. When a positive voltage appears on terminal 248 (with respect to terminal 250) terminals 252, 254 are placed in electrical contact with each other and current may flow from either terminal to the other. As soon as the positive voltage is removed from terminal 248, terminals 252, 254 are electrically isolated and no current flows in either direction. Relay 244 is constructed the same and functions in the same manner as relay 246. A varistor 256, like varistor 98, provides the same function between terminals 252, 254 as varistor 98 provides across one side of transformer 96. Another varistor, like varistor 256, is connected across solid state relay 244. Terminal 250 as well as the corresponding terminal in relay 244 are each connected via a conductor 258 to ground. Terminal 252 is connected via a conductor 260 to one side of the 220-volt source provided through plug 90. The terminal corresponding to terminal 252 in relay 244 is connected to a conductor 262, such being connected to the other side of the 220-volt source. Terminal 254 is connected to a conductor 264, such being connected to one side of the power plug receptacle 88. The corresponding terminal on relay 244 is connected to a conductor 266 which supplies the other side of power plug receptacle 88. As will be recalled, the pump motor is connectable to receptacle 88 via pump motor power cable 32 (in FIG. 1). Conductors 260, 264 each include a conventional fuse, both of which are indicated generally at 268.

Returning again to terminal 164 located in the left-hand portion of the schematic, the terminal is also connected to a conductor 270 which in turn is connected to a middle terminal 272 of a conventional audio beeper 274. Beeper 274 includes a lower terminal 276 and an upper terminal 278. Beeper 274 functions as follows: when a high voltage level (with respect to terminal 276) appears on terminal 278 only, with no voltage being applied to terminal 272, beeper 274 emits a steady audible tone. When a high voltage appears on terminal 272, with respect to terminal 276, beeper 274 emits a series of aurally discernible tones, regardless of whether or not voltage is being applied to terminal 278. Terminal 276 of beeper 274 is electrically connected to ground as shown. Terminal 278 is electrically connected via a conductor 280 to terminal 118 in switch 86.

Terminal 166 is electrically connected via a conductor as shown to a terminal 282. Terminal 282 is electrically connected via a conductor (not shown) to terminal 112 so that the power supply voltage appears on terminal 112.

Terminal 168 is connected to an SCR 284 in the same configuration and with the same-valued biasing resistors as SCR 172. Like SCR 172, the anode of SCR 284 is connected to a terminal 286 which in turn is connected via a conductor (not shown) to the power supply voltage on terminal 112. The cathode of SCR 284 is connected to a conductor 288 which is connected to an input terminal of an inverter 290. Inverter 290 includes an input terminal and an output terminal as shown and functions in the same manner as inverter 186. The output terminal of inverter 290 is connected to input terminal 196 of AND gate 194. Conductor 288 is also connected to a conductor 292 which in turn is connected to an input terminal of an AND gate 294. AND gate 294 includes the same input terminals and output terminal and functions in the same manner as the previously-described AND gates. AND gate 294 is referred to herein as a second AND means or gate. A conductor 296 is electrically connected to conductor 182 and the other input of AND gate 294. The output terminal of AND gate 294 is connected as shown to an input terminal of an AND gate 298. AND gate 298 is referred to herein as float AND means or a fourth AND gate. The other input terminal of AND gate 298 is connected via a conductor 300 to conductor 162. The output terminal of AND gate 298 is connected via a conductor as shown to an inverter 302. Inverter 302 includes an input terminal and an output terminal, like inverter 186, and functions in the same manner as the previously-described inverters. The output terminal of inverter 302 is connected to a conductor 304 which in turn is connected to conductor 240.

Description will now be made of the manner in which pump assembly 10 is used and of the manner in which circuit 70 controls the application of power to the pump. In an area in which it is known that hydrocarbons, e.g., gasoline, is floating on the water table, a bore like bore 12 is drilled into the ground beneath the water table. The surrounding water and gasoline fill the bore with a column of water having a column of gasoline floating thereon. A first water pump (not shown in the drawings) is lowered to the bottom of the bore and is turned on to pump water therefrom. As water is pumped from the bore, water in the formation surrounding the bore begins moving toward the bore causing a lowering of surface 21 of the water table in the area of the bore. Gasoline floating on surface 21 tends to move into the bore thus creating a gasoline column 18 floating on a water column 14.

Power cable 32 includes a plug (not shown) at its upper end which is plugged into receptacle 88 in FIG. 3. Plug 41 is plugged into receptacle 72 in FIG. 3 with the six conductors in cable 40 connecting the components in probe assembly 36 with the conductors connected to receptacle 72 as described above.

The circuit shown in FIG. 3 is typically contained in an explosion-proof box and remains at the surface of the well while pump assembly 10 is lowered into the well on steel cable 34. When lowering the assembly shown in FIG. 1 into the well, switch 86 is placed in the PROBE position. When so positioned, arms 148, 150 are each moved downwardly to place terminals 140, 142 in electrical contact with each other and to place terminals 144, 146 in electrical contact with each other. In so doing, terminal 140 (which is connected by conductors to the power supply voltage on terminal 112) is placed on terminal 142 which is connected via conductors 158, 154 to conductor 76, the common side of the reed magnetic switches within rod 60.

When probe assembly 36 is immersed in fluid in the well bore, float 64 (in FIG. 2) floats upwardly to abut against nut 62. In so doing, both of the reed magnetic switches contained within rod 60 are switched. When the upper switch is switched, the voltage appearing on conductor 76, the switch common, is applied to conductor 74, the other side of the upper switch. The voltage on conductor 74 is applied through arm 128 to conductor 280 which is attached to upper terminal 278 of beeper 274. Thus, the pump operator is alerted that the pump is immersed in liquid when beeper 274 emits a continuous tone.

When probe assembly 36 is first lowered into gasoline 18, the voltage applied to rod 60 via cable 40 and conductor 82 is not placed on either of rods 52, 56 in the high and lower probes due to the high resistivity of gasoline. However, as soon as rod 52 is lowered into water column 14, the voltage from rod 60 is applied to rod 52 (which is connected via cable 40 to conductor 80 in circuit 70). Thus, when the exposed lower portion of rod 52 is at gasoline/water interface 16, a high voltage level is placed on terminal 164 and, via conductor 270, on middle terminal 272 of beeper 274. Thus, when the lower exposed portion of the high probe is at the interface, the beeper emits a series of discernible tones thus alerting the operator to stop lowering so that the pump assembly may be positioned with respect to gasoline/-water interface 16 as shown in FIG. 1.

Once the pump assembly is so positioned, switch 86 is switched to its AUTO position. In that position, arms 128, 130 are each moved to their lower positions to place terminals 126, 127 and terminals 130, 132, respectively, in communication with each other. Arms 148, 150 remain as shown in FIG. 3. Such switching places the power supply voltage from terminal 112 on conductor 234 and on the anode of diode 156 via terminal 127 and switch 86. Since the low switch in rod 60 is closed due to the flotation of float 64, the voltage appearing at the anode of diode 156 is applied through the diode via conductors 154, 76, through the closed switch to conductor 78 which in turn applies the voltage to conductor 162 through terminal 160.

The pump assembly is now in position for automatically pumping gasoline 18 to the surface via hose 30. After the pump assembly is positioned as shown in FIG. 1, gasoline continues to flow on surface 21 into well bore 12 thus increasing the height of gasoline column 18. As the amount of gasoline in the column increases, the weight of the gasoline pushes water/gasoline interface 16 downwardly. Once the interface is beneath rod 52, terminal 164 changes from a high to a low voltage state. Since rod 52 is immersed only in gasoline, the voltage on rod 60 does not appear on rod 52 due to the high resistivity of the gasoline. As interface 16 continues downward movement due to the increasing weight of gasoline accumulating in the bore, the interface ultimately passes beneath rod 56. When such occurs, terminal 168 changes from a high to a low state.

When terminals 164, 168 are both in a low state, SCR's 172, 284, do not conduct and thus conductors 182, 288 are placed in a low voltage state. Each of conductors 182, 288 are connected to the inputs of inverters 186, 290. When each conductor is in a low voltage state, high voltage states appear at the inputs 192, 196 of AND gate 194 thus placing a high voltage state at one input of AND gate 200. As will be recalled, flotation of float 64 places conductor 162 in a high voltage state thus applying a high voltage to the other input of AND gate 200 and placing a high voltage on conductor 204.

When conductor 204 goes to a high state, timer 214 begins timing. At the end of the timed period, terminal 216 goes to a high state thus raising terminal 224 on switch 226 to a high level and applying the power supply voltage through arm 128 in switch 86 to conductor 242. The appearance of the power supply voltage on conductor 242 energizes relays 244, 246 which applies 220 volts from conductors 260, 262 to conductors 264, 266 thus energizing the pump.

AND gates 294, 298 serve to latch the pump in its on condition. After the pump assembly is set at interface 16 as in FIG. 1, and when interface 16 dips below rod 52 in the high probe, the voltage level on conductor 182 changes to a low level as has been previously described. This low voltage level is applied via conductor 296 to one input of AND gate 294 and as will be recalled, whenever either of the AND gates' inputs are low, the output is low. Accordingly, the output of AND gate 298 is likewise low, thus generating a high voltage on the output terminal of inverter 302. This high level is applied via conductors 304, 240 to the control terminal of switch 236 thus placing the switch terminals of the switch in electrical contact with each other. At this point, switches 233, 236 are in a closed condition while switches 226, 232 are in an open condition. When output terminal 216 of timer 214 goes to a high level, as has been previously described, switch 226 closes thus applying the power supply voltage to switch terminal 230 and hence through switch 236 to the control terminal switch 232 thus closing the switch and latching the motor in an on condition.

Thus far interface 16 has lowered to exposed lower end of rod 56 which, as will be recalled, started the timer. During the predetermined timing period, interface 16 continues lowering beneath rod 56. At the end of the timing period, the output terminal 216 of timer 214 went to a high voltage level which turned on the pump. As gasoline is pumped from column 18 interface 16 begins rising due to the decreased weight of the gasoline. When the gasoline raises to the level of the exposed lower end of rod 56 on the lower probe, the water between the lower probe and rod 60 permits application of the voltage on rod 60 to rod 56 thus causing a high voltage level at terminal 168 which triggers SCR 284 thus placing high level at the input of inverter 290. The low voltage level placed by inverter 290 on input terminal 196 of AND gate 194 causes a low level input to AND gate 200 and thus a low level output on conductor 204. As will be recalled, such a low signal level on conductor 204 causes output terminal 216 of the timer to go to a low level thus opening switch 226. However, since closed switch 232 is in parallel with switch 226, the motor remains latched on.

Interface 16 continues rising as gasoline is pumped. When the interface reaches the high probe as shown in FIG. 2, the voltage level at terminal 164 goes to a high level thus firing SCR 172 and placing a high level input into the other input terminal of AND gate 294. Since both input terminals of gate 294 are at a high level, its output is high as is the output terminal of AND gate 298. With a high voltage level on inverter 302, a low level is placed on the control terminal of switch 236 via conductors 304, 240, thus opening the switch. When switch 236 opens, the control terminal of switch 232 goes to a low level thus opening switch 232 and de-energizing relays 244, 246, and hence the pump motor.

Once the motor is de-energized, gasoline column 18 begins building thus lowering the interface and the cycle is repeated. The movement of interface 16 and its effect on circuit 70 may be summarized as follows: the interface moves downwardly from the lower end of the high probe until it reaches the lower end of the low probe. At this point, the timer starts timing while the interface continues downward movement. At the end of the predetermined timing period, the pump motor switches on thus pumping gasoline from the bore and causing the interface to begin rising. Once the interface again rises to the lower end of the high probe, the pump switches off and thereafter, the interface again begins downward movement.

For some uses, it may be desired to switch the pump so that it runs continuously. This may be achieved by switching switch 86 to the HAND position. This position moves arms 128, 130 and arms 148, 150 to their lowermost position thus placing terminals 130, 132 and terminals 140, 146 in common. This applies the power supply voltage from terminal 112 directly to conductor 242 thus energizing relays 244, 246 and maintaining the motor continuously in an on condition.

It is to be appreciated that modifications and additions may be made to the instant embodiment of the invention without departing from the spirit of the invention as defined in the following claims.

I claim:

1. A digital control circuit for a pump of the type used to pump a column of hydrocardons floating on a column of water, such a pump having means for generating a first signal when the pump intake is received within nonconducting fluid, means for generating a second signal when the pump intake is a predetermined distance above a nonconducting fluid, and a float switch adapted to switch when the pump intake is received within liquid, said circuit comprising:

a first AND gate operatively connected to said signal generating means for generating a high signal level on an output terminal when both the first and second signals are present;

a second AND gate operatively connected to said signal generating means for generating a high signal level on an output terminal when neither of the first and second signals are present;

a third AND gate operatively connected to said first AND gate and to said float switch for generating a high signal level on an output terminal when said first AND gate output is high and said pump intake is received within liquid;

a fourth AND gate operatively connected to said second AND gate and to said float switch for generating a high signal level on an output terminal when said second AND gate output is high and when said pump intake is received within liquid;

a timer operatively connected to said third AND gate, said timer generating a high level on an output terminal a preselected time after the output terminal of said third AND gate changes to a high level, said timer maintaining said high output for so long as said third AND gate output remains high;

a pump motor power supply;

switch means operatively connected to said timer, to said power supply, and to the pump motor, said switch means applying power to the pump motor for so long as the timer output remains high; and latch means operatively connected to said fourth AND gate and to said switch means for maintaining application of power to the pump motor until the fourth AND gate output changes to a high level.

2. The apparatus of claim 1 wherein said latch means comprises a first bilateral switch connected in parallel to said switch means, said bilateral switch having a control terminal for switching the switch, and a second bilateral switch connected between the pump side of said switch means and the control terminal of said first switch, the control terminal of said second switch being operatively connected to said fourth AND gate output terminal.

3. In a digital circuit for controlling a pump of the type having a high probe at the pump intake and a low probe beneath the pump intake and further having a float switch adapted to switch when a liquid level is at the pump intake, first AND means operatively connected to said probes for generating a predetermined signal when the pump probes are immersed in a nonconducting fluid;

means for energizing said pump responsive to a pump energization signal;

a time delay, operatively connected to said first AND means and to said pump energization means, said time delay generating a pump energization signal a preselected length of time after generation of said predetermined signal level;

second AND means operatively connected to said probes and to said pump energization means, said second AND means generating a latch signal for maintaining said pump in an energized condition unless said probes are immersed in a nonconducting fluid; and float AND means disposed between said first AND means and said time delay and being operatively connected to said float switch, said float AND means inhibiting generation of said predetermined signal when the pump intake is above liquid level.

4. In a digital circuit for controlling a pump of the type having a high probe at the pump intake and a low probe beneath the pump intake and further having a float switch adapted to switch when a liquid level is at the pump intake, first AND means operatively connected to said probes for generating a predetermined signal when the pump probes are immersed in a nonconducting fluid;

means for energizing said pump responsive to a pump energization signal;

a time delay, operatively connected to said first AND means and to said pump energization means, said time delay generating a pump energization signal a preselected length of time after generation of said predetermined signal level;

second AND means operatively connected to said probes and to said pump energization means, said second AND means generating a latch signal for maintaining said pump in an energized condition unless said probes are immersed in a nonconducting fluid; and float AND means disposed between said second AND means and said pump energization means and being operatively connected to said float switch, said float AND means inhibiting generation of said latch signal when the pump intake is above liquid level.

5. In a circuit for controlling a pump of the type having a high probe at the pump intake and a low probe beneath the pump intake and further having a float switch adapted to switch when a liquid level is at the pump intake, means for providing a first signal when said high probe is immersed in a substantially nonconductive liquid;

means for providing a second signal when said low probe is immersed in a substantially nonconductive liquid;

probe logic means for providing a logic output signal in response to said first signal and said second signal;

float logic means for providing a time delay control signal in response to said float switch and said logic output signal;

time delay means, operatively connected to said float logic means, for providing a pump energization signal a preselected length of time after said time delay control signal actuates said time delay means;

pump energization means, responsive to said pump energization signal, for energizing said pump; and latching means, operatively connected to said pump energization means and responsive to said first signal and said second signal, for maintaining said pump in an energized condition after generation of said pump energization signal until said first and second signals are no longer present.

* * * * *